US005900326A

United States Patent [19]

Bornstein et al.

[11] Patent Number: 5,900,326

[45] Date of Patent: May 4, 1999

[54] SPALLATION/DELAMINATION RESISTANT THERMAL BARRIER COATED ARTICLE

[75] Inventors: Norman S. Bornstein, W. Hartford; Raymond A. Zatorski, E. Hampton, both of Conn.

[73] Assignee: United Technologies Corporation, Hartford, Conn.

[21] Appl. No.: 08/991,670

[22] Filed: Dec. 16, 1997

[51] Int. Cl.[6] ..... B32B 15/04; B05D 1/10

[52] U.S. Cl. ..... 428/632; 428/633; 428/678; 428/680; 428/937; 427/454; 427/456

[58] Field of Search ..... 428/632, 633, 428/629, 937, 678, 622, 623, 680; 427/453, 454, 456, 419.2, 405

[56] References Cited

U.S. PATENT DOCUMENTS

| | | | |
|---|---|---|---|
| 4,405,660 | 9/1983 | Ulion et al. | 427/419.2 |
| 4,446,199 | 5/1984 | Gedwill et al. | 428/678 |
| 4,588,607 | 5/1986 | Matarese et al. | 427/34 |
| 4,755,492 | 7/1988 | Greskovich et al. | 501/126 |
| 4,897,372 | 1/1990 | Huseby et al. | 501/96 |
| 5,277,936 | 1/1994 | Olson et al. | 427/453 |
| 5,320,909 | 6/1994 | Scharman et al. | 428/633 |
| 5,397,649 | 3/1995 | Schienle et al. | 428/552 |

*Primary Examiner*—John J. Zimmerman
*Attorney, Agent, or Firm*—Pamela J. Curbelo

[57] ABSTRACT

The present invention relates to a thermal barrier coated article with spallation and delamination inhibiting metallic bond coat. The metallic bond coat contains a reactive element oxide, preferably yttria, which reacts with sulfur, typically migrating from the substrate to the thermal barrier coating, to prevent the sulfur from inducing spallation of the oxide scale at the interface of the thermal barrier coating and the metallic bond coat. This metallic bond coat is preferably multi-layered having a reactive element oxide containing layer sandwiched between two reactive element oxide-free layers.

22 Claims, 2 Drawing Sheets

SPALLATION/DELAMINATION RESISTANT THERMAL BARRIER COATED ARTICLE

TECHNICAL FIELD

The present invention relates to spallation/delamination resistant thermal barrier coated articles, and especially relates to utilizing a reactive element oxide in the metallic coat, which bonds the thermal barrier coating to the article, to inhibit spallation and delamination due to sulfur migration from the article.

BACKGROUND OF THE INVENTION

Many industries conventionally employ thermal barrier coatings to thermally insulate an article. FIG. 1 represents a conventional thermal barrier coated article which typically comprises a metallic layer 5 beneath a thermal barrier coating, often a ceramic layer, 1, applied to a superalloy substrate 10. The ceramic layer, which reduces the surface temperature of the metallic substrate, is chosen based upon thermal conductivity, stability, expansion compatibility with the substrate, and thermocyclic compatibility. Industry typically employs yttria stabilized zirconia as the preferred ceramic layer.

The metallic layer, commonly referred to as a bond coat, functions as a bonding means between the ceramic layer and the substrate. Conventional metallic layers include nickel-aluminum systems which generally consist of a mixture of gamma and beta phases, or the intermetallic compound nickel aluminide (NiAl). Gamma represents the solid solutions of the elements nickel, aluminum, chromium, cobalt, and the other elements that comprise the nickel base superalloys, while beta represents the intermetallic compound of nickel and aluminum frequently modified by the elements commonly present in the superalloys and often alloyed with special elements such as platinum and other precious metal elements.

The interface between the metallic layer and the ceramic layer is typically an oxide scale, such as alumina scale, which bonds the two layers together. Premature failure of these thermal barrier coatings is typically associated with chipping or breaking up (spallation) of the oxide scale. What is needed in the art is an improved thermal barrier coated article which is resistant to delamination of the thermal barrier coating due to oxide scale spallation.

DISCLOSURE OF THE INVENTION

The present invention relates to a thermal barrier coated article having a substrate, a thermal barrier coating, and a metallic coat disposed therebetween. The metallic coating bonds the substrate to the thermal barrier coating and has a reactive element oxide to inhibit sulfur from inducing delamination of the thermal barrier coating.

The present invention further relates to a method for forming a thermal barrier coating comprising the steps of: forming an oxide-free layer on said substrate by plasma spraying a reactive element oxide-free powder at a substrate; forming an oxide-containing layer on said oxide-free layer by plasma spraying a reactive element oxide alloyed powder and said reactive element-free powder at said oxide-free layer; and forming a second oxide-free layer on said oxide-containing layer by plasma spraying a reactive element oxide-free powder on said oxide-containing layer.

The foregoing and other features and advantages of the present invention will become clear from the following description and drawings.

MODE FOR CARRYING OUT THE INVENTION

Figure 1:
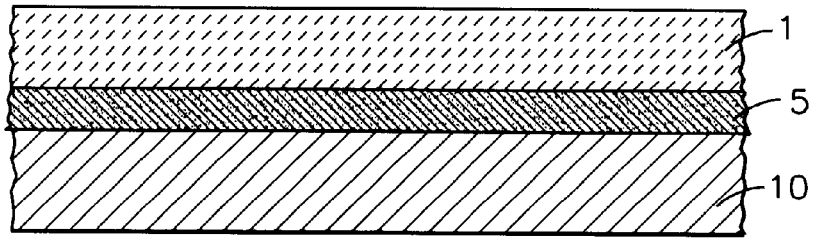
FIG. 1 is a cross-sectional view of a thermal barrier coated substrate.
Figure 2:
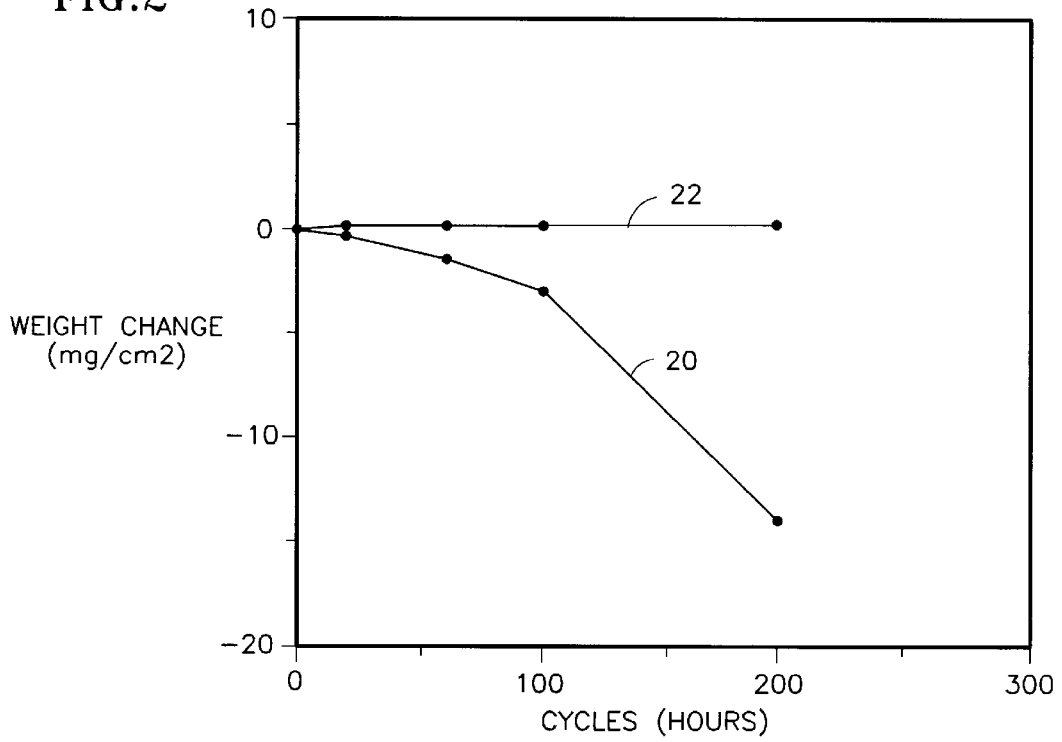
FIG. 2 is a graph of the cyclic oxidation of various materials in relation to sulfur concentration.

The present invention relates to an improved superalloy article having a reactive element oxide enhanced layer. FIG. 2 reveals the ability of sulfur to promote spallation of alumina scale. Line 20 represents the effects of greater than 5 parts per million (ppm) sulfur on alumina scale on nickel aluminide, while line 22 represents the effects of less than 5 ppm sulfur.

It is known that indigenous sulfur within the thermal barrier coating and/or the metallic layer can induce spallation and delamination. Consequently, yttrium has commonly been added to these layers to react with and immobilize the sulfur, thereby preventing this indigenous sulfur from inducing spallation and delamination. This technique, however, has prolonged the structural integrity of the bond between the thermal barrier coating and the metallic layer, however, it has not eliminated the problems of spallation and delamination. It has been discovered that the yttrium in these layers failed to inhibit sulfur migration from the substrate to the metallic layer/thermal barrier coating interface. It has been determined that excess, or unreacted, yttrium within the thermal barrier coating and the metallic layer is apparently immobilized by a yttrium sulfide ($Y_2S_3$) film formed by the reacted yttrium and sulfur in the coating and metallic layer, respectively. Consequently, when sulfur migrates from the substrate, the unreacted yttrium within the metallic layer is incapable of bonding with that sulfur to inhibit further migration.

However, the addition of reactive element oxides to the metallic layer inhibits migrating sulfur, typically indigenous to the substrate, from migrating to the metallic layer/the thermal barrier coating interface and, therefore, from causing oxide scale spallation. For example, yttria is added to the metallic layer. The yttria enhanced metallic layer then inhibits the sulfur migration to the interface, since yttria, in the presence of aluminum, is capable of reacting with and capturing sulfur, according to the following reaction:

$$Y_2O_3+S+2/3Al=Y_2O_2S+1/3Al_2O_3$$

Possible reactive element oxides which can be employed within the metallic layer to trap the sulfur include oxides of yttrium and of the lanthanide series, with lanthanum, cerium, and yttrium preferred, and yttrium especially preferred due to reasons of economy and experience. Sufficient reactive element oxide to react with substantially all of the migrating sulfur should be utilized in the metallic layer. Typically up to about 15 volume percent (vol%) reactive element oxide is sufficient, with up to about 10 vol% preferred and about 2 vol% to about 5 vol% especially preferred.

The particle size of the reactive element oxide is important and should range from submicron to about 10 micrometers ($\mu$m) in order to optimize available surface area, reactive area, of the reactive element oxide, and to enable substantially uniform dispersion of the reactive element oxide within the metallic layer. Reactive element oxide particle sizes exceeding about 15 $\mu$m typically produce relatively weak metallic layers due to difficulty bonding the reactive element oxide to the metal.

The metallic layer, which can be composed of an intermetallic compound, such as nickel (Ni), aluminum (Al), and/or cobalt (Co) containing mixtures or alloys, and a reactive element oxide, is preferably multi-layered since these oxide particles produce a weak interface with the substrate and or thermal barrier coating. Consequently, the preferred metallic layer comprises two oxide-free metal layers, with an oxide containing layer disposed therebetween. Generally, the thickness of the layers is such that about half of the volume of the metallic layer is the oxide containing layer. Essentially, each oxide-free metal layer should have sufficient thickness to bond the metallic layer to the substrate and thermal barrier coating, respectively, while the oxide containing layer should have sufficient thickness to contain a sufficient amount of reactive element oxide to react with migrating sulfur, and thereby inhibit spallation. Typically the oxide-free metal layers have a thickness up to about 100 μm, with an up to about 45 μm thick oxide-free metal layer bonded to the substrate and an up to about 55 μm thick oxide-free metal layer bonded to the thermal barrier coating preferred. Typical oxide containing layers have a thickness of up to about 60 μm, with up to about 40 μm preferred.

Deposition of the metallic layer onto the substrate can be performed in numerous ways, including via the employment of conventional plasma spray equipment, such as a low pressure plasma spray unit or an air plasma spray unit. The layers can be applied to the substrate through the use of separate spray sources (i.e. two different plasma spray units, or two different material supplies and one mixing-type nozzle or two nozzles). The metal and the reactive element oxide can be mixed to form the oxide containing layer prior to being supplied to the spray unit, within the spray unit, or in the space between the spray unit and the substrate surface.

For example, a metallic layer is formed by utilizing two plasma spray feeders, the first feeder containing reactive element oxide-free, metal powder and the second unit containing mechanically alloyed reactive element oxide and metal powder. The first unit sprays the oxide-free, metal powder onto the substrate to form an oxide-free layer. When the desired thickness has been obtained, the spray from the first unit is terminated and the second unit sprays the oxide containing layer onto the oxide-free layer. Again, once the desired thickness has been obtained, the second unit discontinues spraying and the first unit applies the final oxide-free layer.

An alternative method for applying the metallic layer could comprise utilizing two feeders, one containing the metal and the other containing the reactive element oxide. In this method the metal would be continuously fed to the nozzle while the reactive element oxide would only be fed to the nozzle once the desired thickness of the first oxide-free metal layer had been obtained, and for a period sufficient to obtain the desired thickness of the reactive element oxide-metal layer.

EXAMPLE

The following example has been utilized to apply a yttria containing metallic layer to a nickel base single crystal substrate.

Two feeders with 1.8 mm powder ports, attached to a single low pressure plasma spray gun having an 8 mm nozzle, were utilized to apply Amdry 386, a nickel-cobalt-chromium-aluminum alloy, and mechanically alloyed yttria powder (10 vol% yttria) and Amdry 386. The powders were applied to a substrate by directing the Amdry 386 through the gun with an argon carrier gas at a flow rate of 3.5 l/m (standard liters per minute) at a feed rate of 8 lbs/hr (pounds per hour) each. The chamber pressure was 200–300 torr with a standoff distance of 300 mm. An initial layer with a thickness of 25.4 μm was obtained with two passes of the gun using the Amdry 386 powder feeder. Then a layer with a thickness of 76.2 μm was obtained with four passes of the gun using the alloyed yttria-Amdry 386 feeder. The Amdry 386 powder feeder was then again used to apply a layer with a thickness of 50.8 μm. The resulting coating had a thickness of 152 μm. The thermal barrier top coating was then applied in air by conventional arc plasma or in a partial vacuum by electron beam physical vapor deposition.

Figure 3:
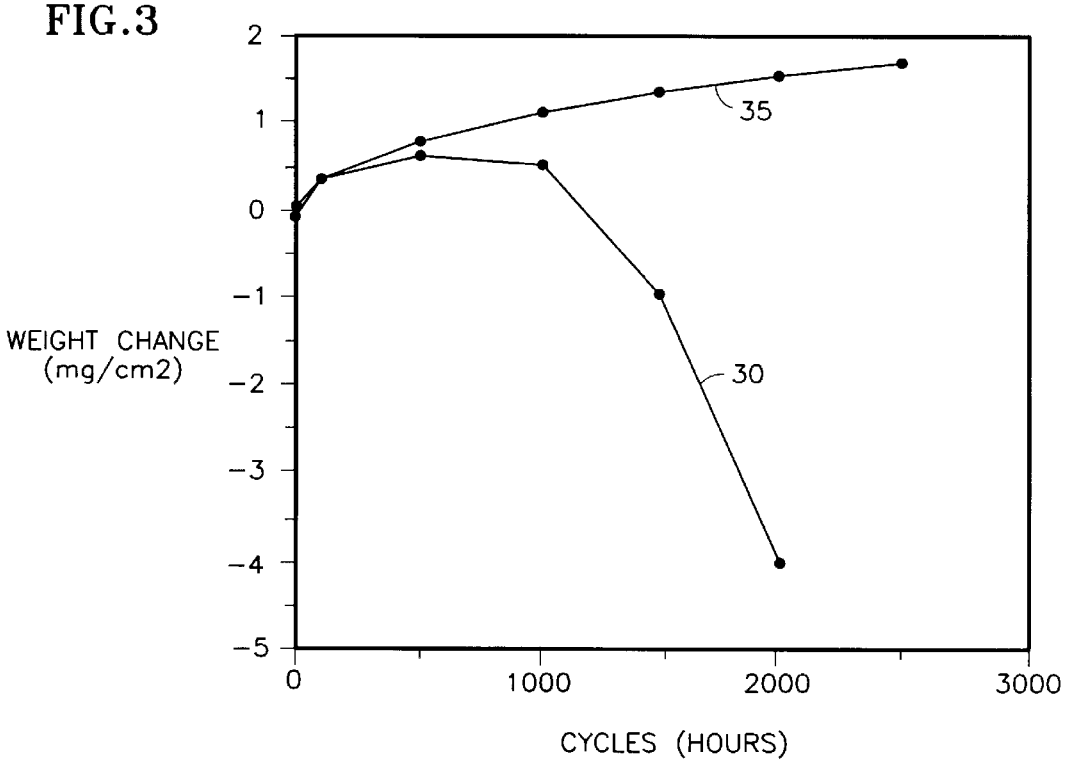
FIG. 3 is a graph of the cyclic oxidation of conventional coatings and the coating of the present invention.

Referring to FIG. 3, a 100 ppm sulfur enriched nickel base superalloy substrate without an enhanced yttria metallic layer, line 30, is compared to a 100 ppm enriched nickel base superalloy substrate with an enhanced yttria metallic layer, line 35. Clearly from the graph of weight change versus cycle time, the non-yttria enhanced coated substrate, line 30, began failing around 1000 cycles, with substantial failure by 2000 cycles, while the yttria enhanced coated substrate remained thermally stable and well bonded for greater than 2500 cycles with no signs of failure. Unlike prior art thermal barrier coated substrates, the substrates of the present invention have extended durability, structural integrity, due to a resistance to sulfur induced spallation and, in turn, delamination.

It will be understood that various modifications may be made to the embodiments disclosed herein. Therefore, the above description should not be construed as limiting, but merely as examples of the preferred embodiments. Those skilled in the art will envision other modifications within the scope and spirit of the claims appended hereto.

What is claimed is:

1. A thermal barrier coated article, comprising:

a. a substrate;

b. a thermal barrier coating on said substrate; and c. a metallic layer which bonds said thermal barrier coating to said substrate, said metallic layer having a sufficient amount of reactive element oxide to inhibit sulfur induced spallation of the interface between said thermal barrier coating and said metallic layer, said metallic layer having a first reactive element oxide-free layer bonded to said substrate, a second reactive element oxide-free layer bonded to said thermal barrier coating, and a reactive element oxide layer disposed between said first reactive element oxide-free layer and said second reactive element oxide-free layer.

2. An article as in claim 1, wherein said reactive element oxide is yttria or a lanthanide series oxide.

3. An article as in claim 2, wherein said metallic layer comprises up to about 15 vol% reactive element oxide.

4. An article as in claim 2, wherein said metallic layer comprises about 2 vol% to about 4 vol% reactive element oxide.

5. An article as in claim 2, wherein said reactive element oxide has a particle size less than about 15 μm.

6. An article as in claim 1, wherein said first reactive element oxide-free layer has a thickness sufficient to bond said metallic layer to said substrate; said reactive element oxide layer has a thickness sufficient to contain a sufficient amount of reactive element oxide to bond with substantially all sulfur which may migrate from said substrate through said metallic layer; and said second reactive element oxide-free layer having a thickness sufficient to bond said metallic layer to said thermal barrier coating.

7. An article as in claim 6 wherein said metallic layer has a thickness and said reactive element oxide layer has a thickness of approximately one-half of the thickness of said metallic layer.

8. An article as in claim 1, wherein said first reactive element oxide-free layer has a thickness of up to about 45 μm; said reactant element oxide layer has a thickness of up to about 60 μm; and said second reactive element oxide-free layer a thickness of up to about 55 μm.

9. An article as in claim 1, wherein said reactive element oxide layer has a thickness of about 25 μm to about 50 μm.

10. An article as in claim 9, wherein said first reactive element oxide-free layer has a thickness of about 25 μm to about 50 μm.

11. A method for forming a thermal barrier coating on a substrate, comprising the steps of:

a. using a plasma spray unit;

b. forming an oxide-free layer on said substrate by plasma spraying a reactive element oxide-free powder onto the substrate;

c. forming an oxide-containing layer on said oxide-free layer by plasma spraying a reactive element oxide alloyed powder and said reactive element-free powder onto said oxide-free layer; and d. forming a second oxide-free layer on said oxide-containing layer by plasma spraying a reactive element oxide-free powder onto said oxide-containing layer.

12. A method as in claim 11, wherein said reactive element oxide-containing layer contains up to 15 vol% reactive element oxide.

13. A method as in claim 11, wherein said reactive element oxide-containing layer comprises about 2 vol% to about 4 vol% reactive element oxide.

14. A method as in claim 11 wherein said reactive element oxide has a particle size less than about 15 μm.

15. A method as in claim 11 wherein said reactive element oxide has a particle size up to about 10 μm.

16. A method as in claim 11, wherein said reactive element oxide is yttria or a lanthanide series metal oxide.

17. A thermal barrier coated article, comprising:

a. a substrate;

b. a thermal barrier coating on said substrate; and c. a metallic layer which bonds said thermal barrier coating to said substrate, said metallic layer having a first yttria-free layer bonded to said substrate, a yttria-free layer bonded to said thermal barrier coating, and a yttria layer disposed between said first yttria-free layer and said second yttria-free layer; wherein said yttria inhibits sulfur from inducing spallation of the interface between said thermal barrier coating and said second yttria-free layer.

18. An article as in claim 17, wherein said yttria layer comprises up to about 15 vol% yttria.

19. An article as in claim 17, wherein said yttria layer comprises about 2 vol% to about 4 vol% yttria.

20. An article as in claim 17, wherein said yttria has a particle size less than about 15 μm.

21. An article as in claim 17, wherein said yttria has a particle size up to about 10 μm.

22. An article as in claim 17, wherein said first yttria-free layer has a thickness sufficient to bond said metallic layer to said substrate; said yttria layer has a thickness sufficient to contain a sufficient amount of yttria to bond with substantially all sulfur migrating from said substrate through said metallic layer; and said second yttria-free layer having a thickness sufficient to bond said metallic layer to said thermal barrier coating.

* * * * *

UNITED STATES PATENT AND TRADEMARK OFFICE

CERTIFICATE OF CORRECTION

PATENT NO. : 5,900,326

DATED : May 4, 1999

INVENTOR(S): Norman S. Bornstein et al.

It is certified that error appears in the above-identified patent and that said Letters Patent are hereby corrected as shown below:

Column 5, claim 7, line 1, following "claim", change "6" to –1–.

Signed and Sealed this

Eighth Day of February, 2000

*Attest:*

*Attesting Officer*

Q. TODD DICKINSON

*Commissioner of Patents and Trademarks*